US008500051B2

(12) United States Patent
Sauser

(10) Patent No.: US 8,500,051 B2
(45) **Date of Patent: *Aug. 6, 2013**

(54) POWER CABLE MANAGEMENT SYSTEM

(75) Inventor: Edwin J. Sauser, Monticello, IA (US)

(73) Assignee: Terex USA, LLC, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/483,882

(22) Filed: May 30, 2012

(65) Prior Publication Data

US 2012/0234948 A1 Sep. 20, 2012

Related U.S. Application Data

(63) Continuation of application No. 12/482,143, filed on Jun. 10, 2009, now Pat. No. 8,201,760.

(51) Int. Cl.
*B02C 21/02* (2006.01)

(52) U.S. Cl.
USPC ..... 241/101.74

(58) Field of Classification Search
USPC ..... 241/101.2, 101.74–101.77; 248/58; 414/785
See application file for complete search history.

(56) References Cited

U.S. PATENT DOCUMENTS 3,030,034 A 4/1962 Becker
7,464,889 B2 12/2008 Westerman et al.
8,201,760 B2 * 6/2012 Sauser ..... 241/30

* cited by examiner

*Primary Examiner* — Mark Rosenbaum
(74) *Attorney, Agent, or Firm* — Simmons Perrine Moyer Bergman PLC

(57) ABSTRACT

An articulating flexible overhead boom disposed on one aggregate processing plant and configured to pivot so as to hold a power cable connecting two adjacent aggregate processing plants at an elevation above the ground so as to permit walking and/or driving a vehicle between the adjacent plants while the connection power cable remains overhead.

16 Claims, 5 Drawing Sheets

POWER CABLE MANAGEMENT SYSTEM

CROSS REFERENCE TO RELATED APPLICATIONS

This application is a continuation and claims the benefit of a utility application filed on Jun. 10, 2009, and having Ser. No. 12/482,143.

BACKGROUND OF THE INVENTION

This invention relates to a mobile rock crushing and screening plant. A portable rock crushing and screening processing plant is usually a collection of several units, each performing various material processing functions to prepare aggregate materials for use for, but not limited to, concrete and asphalt products. The various units can perform various stages of crushing, screening, conveying, and washing of aggregate and recycled materials. Portability is achieved by breaking the plant units into towable or haulable modules, so that the plant can service multiple locations where processed materials can be produced.

Many plants utilize electric motors to drive processing equipment. Electric power is normally provided from commercial power distribution lines or from single or multiple diesel engine-powered generators, also known as Gensets. Electric motors that drive various processing equipment can have power provided from a central motor control center or from multiple motor control panels distributed among the units.

Power supply cables are normally coiled or reeled when equipment is moved from site to site. Once on site, the cables are unrolled and dragged from the power supply to the appropriate processing unit. If a central power distribution center is used, separate motor power cables are strung out from the central power center to the individual motors. These cables are normally laid on the ground, buried in the ground, or hung on hangers running alongside the equipment. This method of deploying cables is time consuming and difficult to duplicate at each site. Some cables are so large that machines are needed to pull the cables into position.

Cables are frequently snagged and damaged while being dragged into position. Cables routed on the ground or hanging along equipment, limit access for maintenance and cleanup of fugitive materials leaking from the processing equipment. Cable outer covers are frequently cut from shovels and machines used for cleanup and maintenance. Cables lying on the ground can become covered or frozen to the ground, making it difficult to move in order to relocate the plant when desired.

Consequently, there is a need for improvement in managing power cables between various components of mobile rock crushing and screening plants.

SUMMARY OF THE INVENTION

More specifically, an object of the invention is to provide an efficient array of mobile rock crushing and screen plants.

It is a feature of the present invention to include an articulating pivoting boom supported power cable system.

It is an advantage of the present invention to avoid many of the problems associated with stringing and laying inter-plant power cables on the ground between the plants and generators powering the plants.

The present invention includes the above-described features and achieves the aforementioned objects.

Accordingly, the present invention comprises an array of mobile electrically powered machinery units, as well as generators which include an articulating boom for supporting power wires connecting the various major components of the array.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
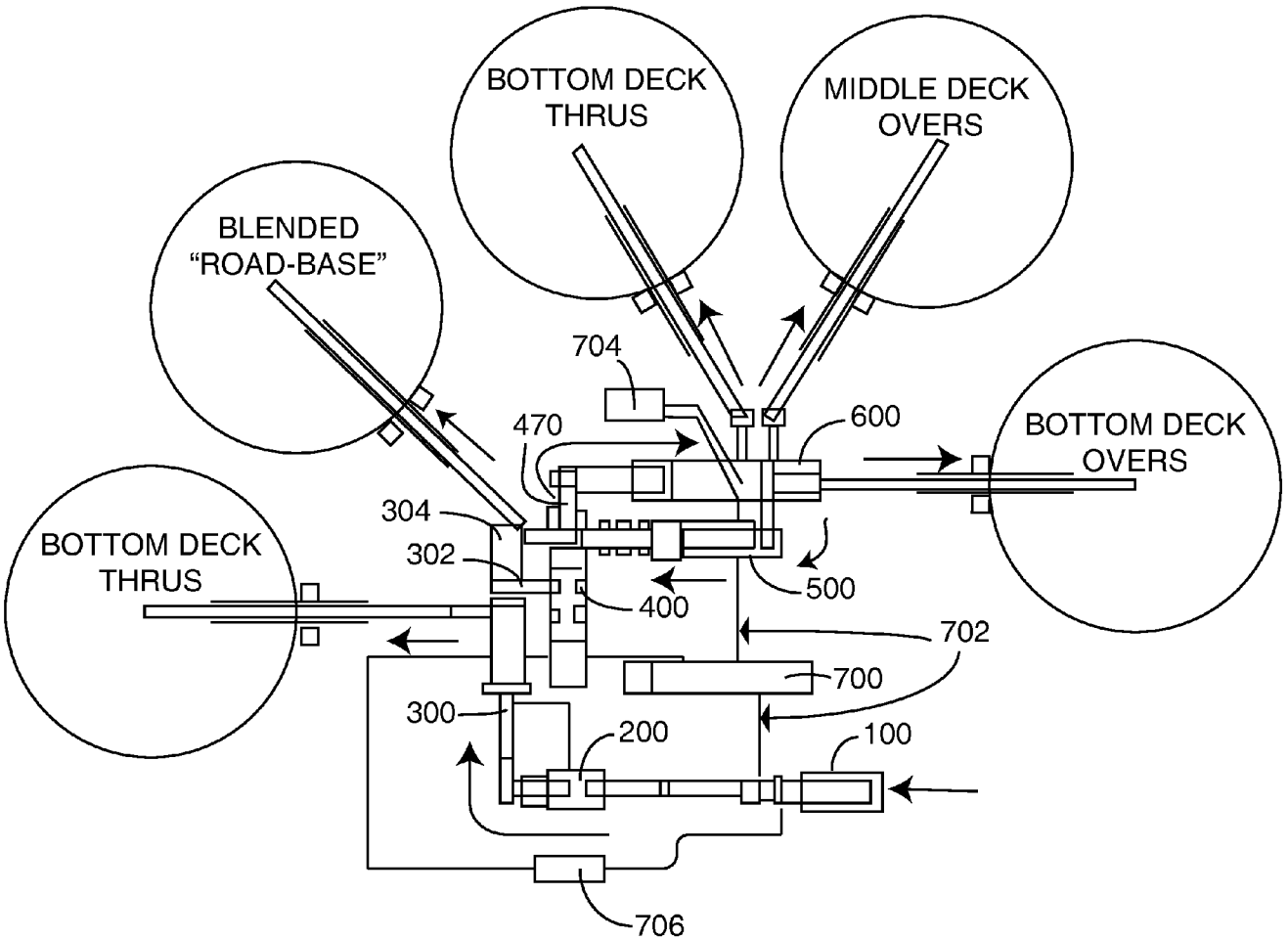
FIG. 1 is a plan view of the system of the prior art disposed interior of an array of stockpiles where the lines drawn between the various units are power and control lines. The lines with arrowheads and no number associated with them show the direction of flow of material through the system.

Referring now to the drawings, where like numerals refer to like matter throughout, and more particularly to FIG. 1, there is shown an array of product piles and a system for processing road building materials of the prior art. There is shown a bifurcatable crusher 100, a surge bin material transfer apparatus 200, and scalping screen 300 and a scalping screen to secondary cone input conveyor 302 and a secondary cone bypass conveyor 304 which delivers the output of scalping screen 300 to the output of secondary cone crusher 400 without running the material through secondary cone crusher 400. Also shown is secondary cone output conveyor 470, which accepts material from three sources, the output of the secondary cone crusher 400, the secondary cone bypass conveyor 304, and the output conveyor of the tertiary cone crusher 500. Secondary cone output conveyor 470 feeds finish screen 600.

Control trailer 700 is the central control and power source for the various components. In one embodiment, the control trailer 700 may provide only control signals leaving the power supplying function to the generators 704 and 706. In another arrangement, control trailer 700 could provide both all power and all control. In still other embodiments, control trailer 700 could provide power in addition to the power from generators 704 and 706. Power supply and control wires 702 would connect the control trailer 700 with the various components. In still other arrangements, control trailer 700 could communicate control signals to the various mobile plant components via a wireless network. It should be understood that the configuration of aggregate processing plants in FIG. 1 is merely exemplary of nearly infinite variations which could benefit from the present invention.

Figure 2:
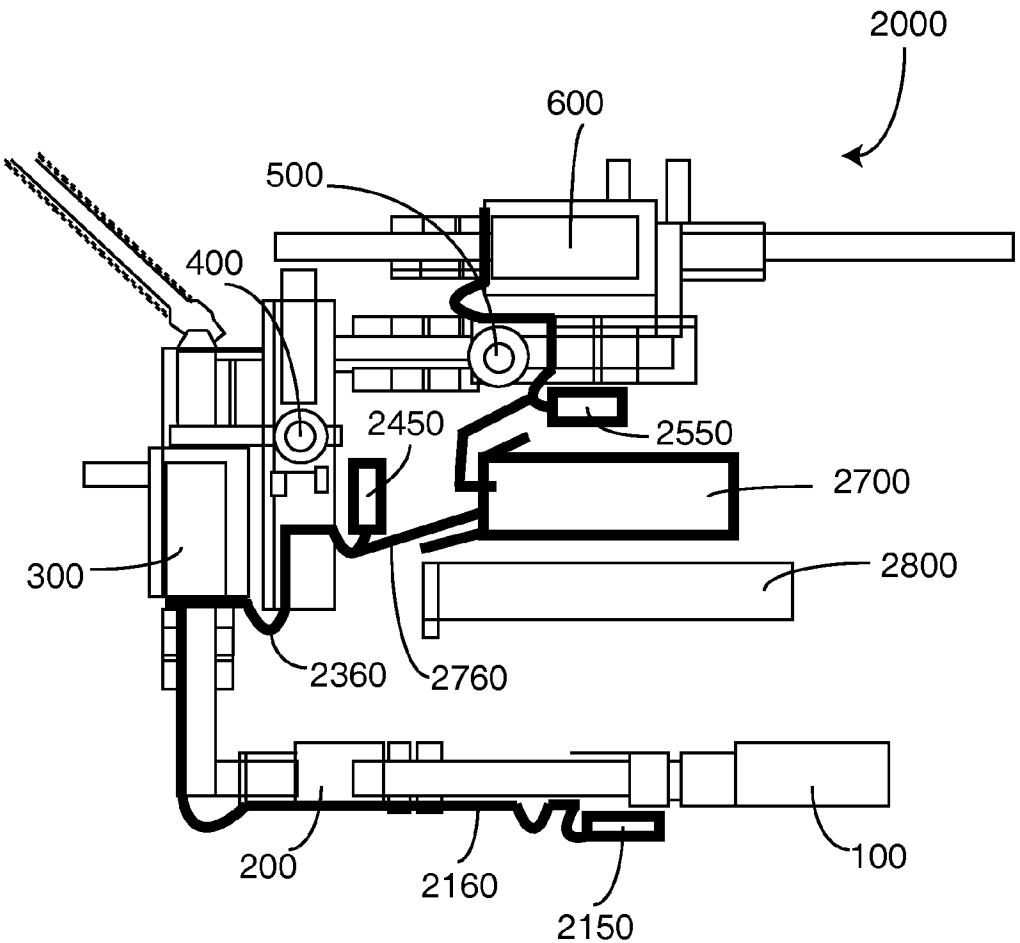
FIG. 2 is a plan view of a representative single generator layout of the power cable management system of the present invention, where the heavy black lines refer to power distribution cables and generating equipment

Now referring to FIG. 2, there is shown a representative mobile rock crushing and screening operation 2000, including several component plant-carried electrical power panels 2150, 2450, and 2550 and a component plant-carried inter-plant electrical power cable 2160 which may include standardized quick connects. Note that the power cables may be single conductor or multiple conductor cords. Generator 2700 is the central control and power source for the various components.

Component plant-carried inter-plant electrical power cable supporting pivot boom 2360 is shown extending between scalping screen 300 and secondary cone crusher 400, as well as between tertiary cone crusher 500 and finish screen 600.

Component plant-carried inter-plant electrical power cable supporting pivot boom 2360 can be as simple as an L-shaped bent pipe pivotally mounted on the side of a plant so that its free end can be swung out for use and swung in for transport.

Component plant-carried inter-plant electrical power cable supporting articulated boom 2760 can be a more complex and versatile boom that is capable of reaching further distances. Control unit 2800 is shown with no connection to any of the various aggregate material processing plants. In such a situation, wireless communication may be employed. Alternatively, control signal lines (much smaller than the power cables discussed herein) could be easily tautly strung between the various aggregate material processing plants. In the configuration as shown, control unit 2800 would likely have its own generator on board.

Panels 2450 and 2550 could be similar to panel 2150.

Figure 3:
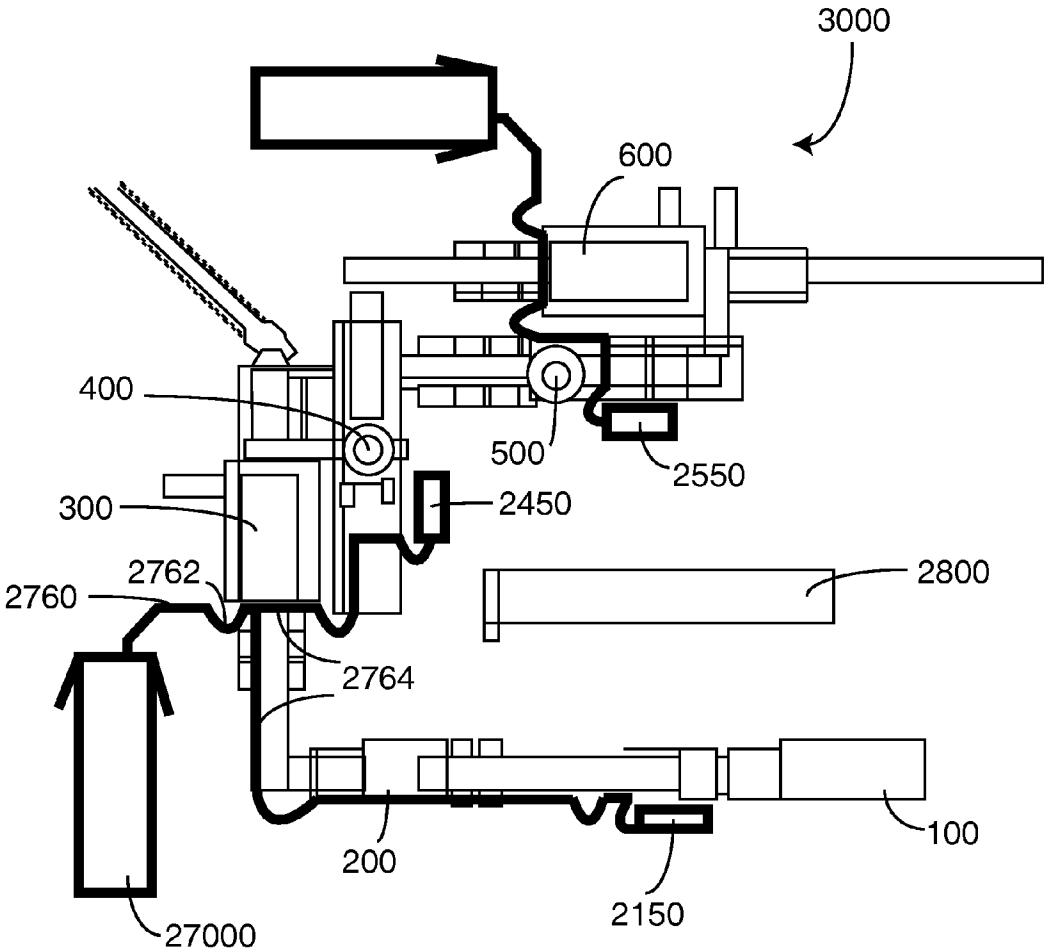
FIG. 3 is a plan view of a representative dual generator layout of the power cable management system of the present invention, where the heavy black lines refer to power distribution cables and generating equipment.

Now referring to FIG. 3, there is shown a dual generator system, generally designated 3000, which is similar to the system of FIG. 2. Irrespective of whether the system is a one or two generator system, power cables may be organized and mounted permanently on processing units (e.g., scalping screen 300 and units 100, 200, 400, 500, 600, 700), so that the cables can easily be connected for distribution of power throughout the plant. The cables may be organized in such a manner to allow power input from one or multiple sources.

Main power supply cables from the power source (generators or line power center) may be organized and attached to a flexible elevated boom, such as component plant-carried inter-plant electrical power cable supporting articulated boom 2760 that can be extended from the power source 27000 to the processing plant 3000. The cables 2762 extending down from the end of the boom attach to a power distribution system 2764 contained within the processing plant 300.

The flexible elevated boom can allow variations in placement of the processing plant relative to the power supply device. The boom can be retracted and stowed alongside or inside the power supply housing. Power cables are frequently stolen due to the value of the cable material. With the ability to retract and stow the power cables and booms within the recesses or recessed enclosures in the wall of the processing plant, or even in a closed and locked boom orientation merely next to a wall of a plant, the cable materials are protected from theft.

Figure 4:
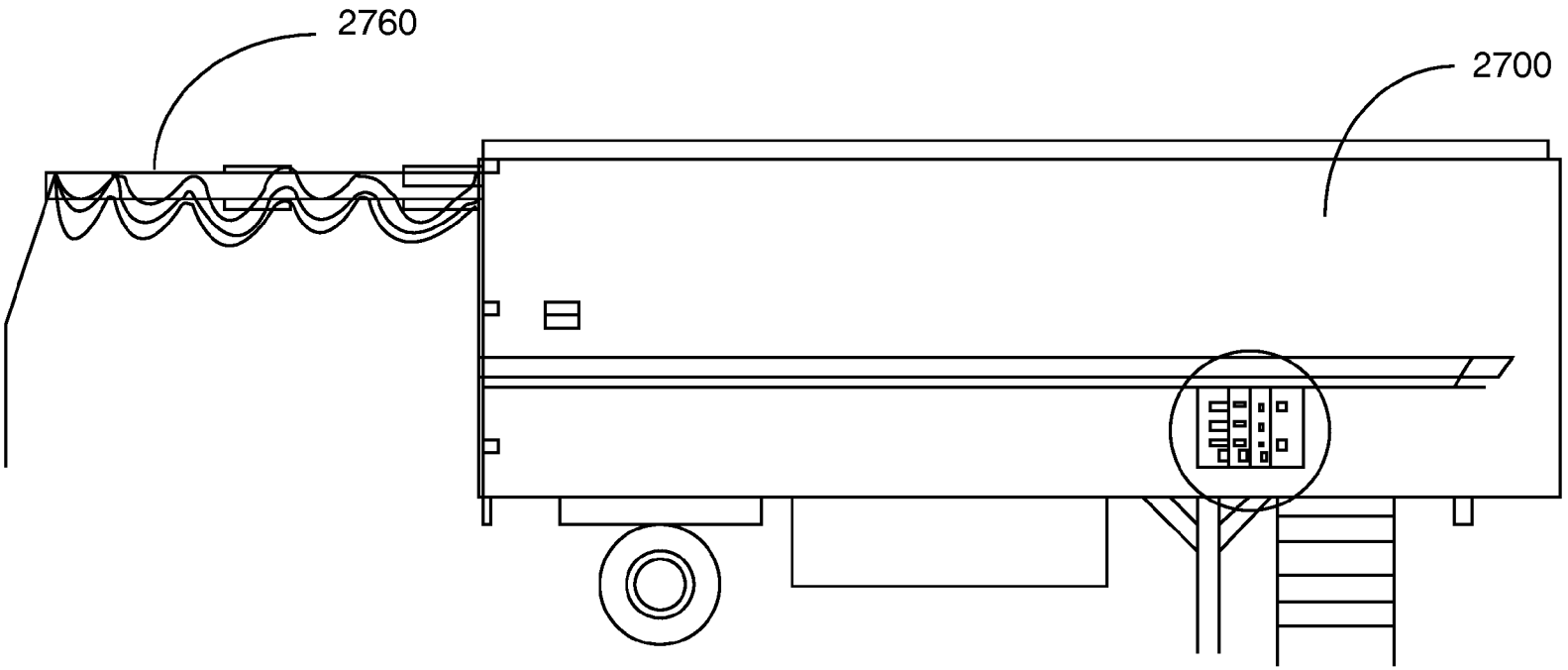
FIG. 4 is a side view of a Genset of FIG. 3 with the boom in an extended position.

Now referring more specifically to FIG. 4, there is shown a generator or Genset 2700 of FIG. 2 wherein the component plant-carried inter-plant electrical power cable supporting articulated boom 2760 is shown in both a deployed (extended) position.

Figure 5:
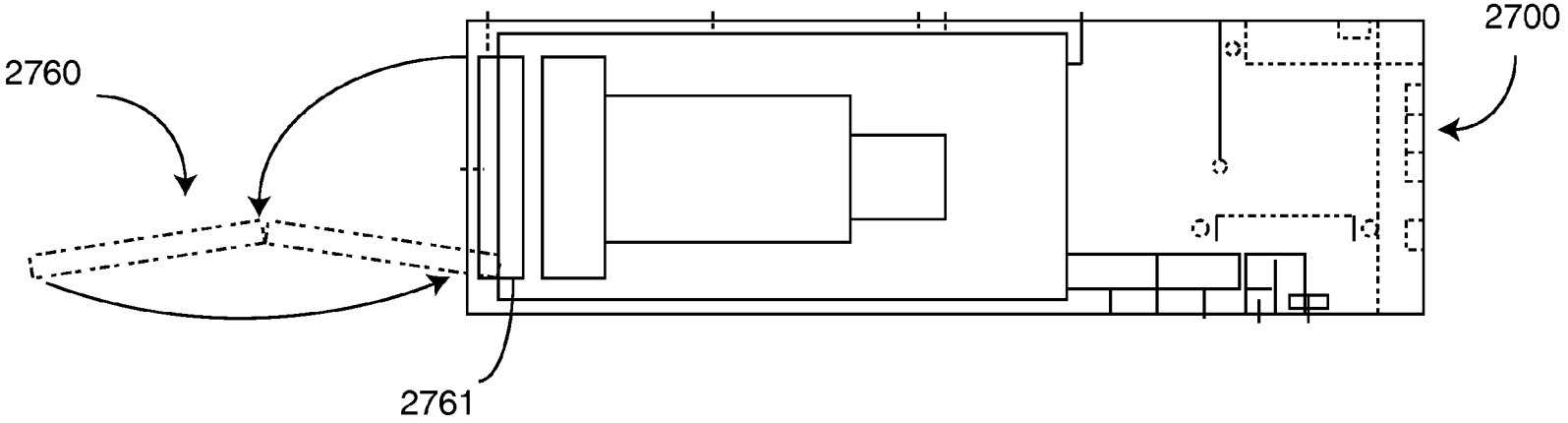
FIG. 5 is a plan view of the Genset of FIG. 4 with the boom in a folded or stowed position and where the dashed lines refer to the extended boom location.

Now referring to FIG. 5, there is shown a Genset 2700 of FIGS. 2, 3 and 4 taken as top side view (looking down) which shows the component plant-carried inter-plant electrical power cable supporting articulated boom 2760 in an extended position (phantom dotted lines) and also in a stowed, closed or locked-down position in a recess 2761. If the component plant-carried inter-plant electrical power cable supporting articulated boom 2760 is locked in the closed position, and the cables are securely fastened to it, the difficulty of removing the cables from the locked/shut boom could result in reductions in theft of the power cables. An electric motor (not shown) could be employed on the component plant or on the boom itself to retract or deploy the component plant-carried inter-plant electrical power cable supporting articulated boom 2760. Of course, no means of assistance might be included or other means of assisting in the moving of the component plant-carried inter-plant electrical power cable supporting articulated boom 2760 could include hydraulic or pneumatic mechanisms, all of which could include winches, gears and shafts, etc.

Throughout this description, the terms "power cable(s)" and "power supply cables(s)" are used. It should be understood that such terms are intended to include wires, cables, insulated electrically conductive rods or other elongated means for conducting electric power. These terms are used herein to refer to very large diameter power distribution lines, and any cable, cord or conductor which is smaller in diameter than 10-gauge wire is specifically excluded from the definition of power cable(s) and power supply cable(s). If multiple small gauge power cables or power supply cables are run in parallel and are electrically coupled together at each end, then they shall be deemed to be power cable(s) and power supply cables(s) as defined and used by the present invention if their combined equivalent gauge is greater than or equal to the 10-gauge minimum discussed above.

It should be understood that in one embodiment, the booms of the present invention could support control cables. It should also be understood that the booms described herein as pivoting may also be non-pivoting solid or telescopic booms, and pivoting solid or telescopic booms as well.

The term "pivot" is used herein to mean "move in an arcuate path irrespective of whether there is a hinge, a single linear pivot axis, a ball joint or other multiple directional movements."

It is believed that when these teachings are combined with the known prior art by a person skilled in the art of mobile rock crushing and screening operations and equipment manufacture, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A mobile relocatable aggregate material processing equipment operation comprising:

a first mobile electrically powered machinery unit configured to be moved between sites and then be parked at a work site and then be coupled to a power source; wherein said first mobile electrically powered machinery unit comprises a mobile relocatable aggregate material processing unit;

wherein said power cable extends entirely between said first mobile electrically powered machinery unit and a second mobile electrically powered machinery unit;

an overhead repositionable boom disposed on said first mobile electrically powered machinery unit, said boom being configured to support a power cable spanning a gap between a second mobile electrically powered machinery unit; said boom being configured to pivot during set up, and then both said boom and said power cable being configured to remain substantially static during operation of said first mobile electrically powered machinery unit and during operation of said second mobile electrically powered machinery unit, which is set for operation at said work site.

2. The apparatus of claim 1 wherein said overhead repositionable boom comprises an overhead extendable boom.

3. The apparatus of claim 2 wherein said mobile relocatable aggregate material processing unit is a rock crusher.

4. The apparatus of claim 2 further comprising a non-articulating pivoting boom coupled to and supporting an inter-plant power cable disposed on one of said mobile electrically powered machinery units, which non-articulating pivoting boom is configured to pivot out for use and pivot in for transport.

5. The apparatus of claim 2 wherein said overhead extendable boom comprises a component plant-carried inter-plant electrical power cable supporting articulated boom with at least one flexible location near a mid-section thereof.

6. The apparatus of claim 5 wherein said component plant-carried inter-plant electrical power cable supporting articulated boom comprises a machine assisting deployment mechanism.

7. The apparatus of claim 6 wherein the machine-assisted deployment mechanism comprises an electrical motor.

8. The apparatus of claim 7 further comprising for each of said first mobile electrically powered machinery unit and said second mobile electrically powered machinery unit; an intra-plant power distribution network comprising a plurality of standardized quick connection points each configured for receiving therein a power supply cord and a plurality of standardized quick connection points each configured for receiving therein a power receiving cord and at least one connection to an electric motor disposed on a mobile electrically powered machinery unit.

9. The apparatus of claim 8 wherein said mobile relocatable aggregate material processing unit is a rock crusher.

10. The apparatus of claim 1 wherein said mobile relocatable aggregate material processing unit is a rock crusher.

11. A mobile aggregate processing system comprising:

a relocatable aggregate material processing unit disposed on a vehicle and set up for operation at a first location and further comprising an electric motor;

a pivoting boom coupled to said relocatable aggregate material processing unit, said boom configured to swing a free boom end away from said relocatable aggregate material processing unit and toward a distant mobile material processing unit so as to support a power cable, with a free cable end thereon, closer toward a connection point, such that said power cable is suspended from above and a ground path around said relocatable aggregate material processing unit is free of any power cables coupling said relocatable aggregate material processing unit and said distant mobile material processing unit; and the pivoting boom being a flexible pivoting boom and further comprises two hinged portions.

12. The system of claim 11 wherein said distant mobile material processing unit is a vibrating screen and said relocatable aggregate material processing unit is a rock crusher.

13. The system of claim 11 further comprising a recess for receiving said boom when said boom is fully retracted to a stowed position.

14. The system of claim 13 further comprising:

powered means for aiding in retracting of said boom.

15. The system of claim 14 wherein said powered means comprises an electric motor.

16. The apparatus of claim 11 wherein said relocatable aggregate material processing unit is a rock crusher.

* * * * *